US005947705A

United States Patent [19]

Mordue et al.

[11] Patent Number: 5,947,705

[45] Date of Patent: Sep. 7, 1999

[54] MOLTEN METAL TRANSFER PUMP

[75] Inventors: George S. Mordue, Ravenna; Chris T. Vild, Cleveland Heights; Herbert L. Ritchie, Jr., Grafton, all of Ohio

[73] Assignee: Metaullics Systems Co., L.P., Solon, Ohio

[21] Appl. No.: 08/907,361

[22] Filed: Aug. 7, 1997

Related U.S. Application Data

[60] Provisional application No. 60/023,550, Aug. 7, 1996.

[51] Int. Cl.[6] ..... F04B 17/00; F04B 39/00

[52] U.S. Cl. ..... 417/423.15; 417/572

[58] Field of Search ..... 417/423.15, 572

[56] References Cited

U.S. PATENT DOCUMENTS

| | | | |
|---|---|---|---|
| 3,058,432 | 10/1962 | Lamb | 417/122 |
| 3,255,702 | 6/1966 | Gehrm | 417/423.15 |
| 4,940,384 | 7/1990 | Amra et al. | 415/121.2 |
| 5,078,572 | 1/1992 | Amra et al. | 415/121.2 |
| 5,088,893 | 2/1992 | Gilbert et al. | 415/200 |
| 5,181,828 | 1/1993 | Gilbert et al. | 415/200 |
| 5,203,681 | 4/1993 | Cooper | 417/424.1 |
| 5,286,163 | 2/1994 | Amra et al. | 415/121.2 |
| 5,330,328 | 7/1994 | Cooper | 417/424.1 |
| 5,454,423 | 10/1995 | Tsuchida et al. | 164/337 |
| 5,470,201 | 11/1995 | Gilbert et al. | 415/200 |
| 5,558,505 | 9/1996 | Mordue et al. | 417/360 |
| 5,586,863 | 12/1996 | Gilbert et al. | 415/200 |
| 5,622,481 | 4/1997 | Thut | 417/319 |
| 5,634,770 | 6/1997 | Gilbert et al. | 415/216.1 |

*Primary Examiner*—Charles G. Freay
*Assistant Examiner*—Paul L. Ratcliffe
*Attorney, Agent, or Firm*—Fay, Sharpe, Beall, Fagan Minnich & McKee, LLP

[57] ABSTRACT

A molten metal pump for transferring molten metal from a first vessel to a second vessel. The pump is constructed of a base member including a pumping chamber, a motor supported by at least one post, a rotatable shaft secured at a first end to said motor and at a second end to an impeller disposed within said pumping chamber. The pumping chamber includes an outlet to a first end of an elongated refractory tube having a longitudinal axis substantially parallel to the shaft. The tube has a second end passing through an opening in the platform. The tube includes a metallic cladding attached to an outer wall adjacent it's second end. A releasable fastening member is used to secure to the portion of the tube having the metallic cladding to the platform.

20 Claims, 6 Drawing Sheets

129
111
135
115
139
141
131
113
125
137
143
132
125
123
119
133
121
117

9
9
1

MOLTEN METAL TRANSFER PUMP

CROSS REFERENCE TO RELATED APPLICATION

This application claims the benefit of U.S. Provisional Patent Application No. 60/023,550, filed Aug. 7, 1996.

BACKGROUND OF THE INVENTION

In the processing of molten metals, for example aluminum and zinc, it is often necessary to pump molten metal from one vessel to another. When the molten metal needs to be removed from a vessel by elevating it over a containment wall, a so-called transfer pump is often used. Most typical of this situation is where the transfer pump is placed in the charge well of a molten metal furnace (see FIG. 1) to remove molten metal from the furnace. Of course, the present invention is not limited to any particular application for a transfer pump.

A problem unique to the design of transfer pumps is the assembly of the riser and its mating to the discharge piping. Particularly, as those skilled in the art understand, the high temperatures to which the riser assembly is exposed and the inherent temperature cycling experienced, place unusual stress on the assembly. More particularly, the riser tube must be constructed of a refractory material to allow for it's submergence in the molten metal bath, while the discharge piping is preferably constructed of a ceramic lined metallic material to provide high strength. Unfortunately, the coupling of these divergent materials can be problematic because of different rates of thermal expansion and comparative strengths.

In the prior art, as demonstrated by the schematic of FIG. 2, a riser is usually cemented at a first end to a pump base assembly and to a riser socket at a second opposed end. The riser socket is then bolted to a motor mount, and the second end of the riser extends slightly above the riser socket to provide a mating surface with the discharge piping assembly.

As will be recognized, this design places a great deal of angular stress on the riser due to the weight of the ceramic lined pipe, flanges and the contained molten metal positioned in a generally tangential direction to the riser. Additionally, the riser must withstand a gasket seating stress which is often exaggerated by uneven or over tightening of the fasteners.

In addition, the riser also shares the stresses experienced by the posts which suspend the base from the motor mount. Compounding this problem is the fact that the riser experiences rapid thermal changes caused by intermittent transferring of metal while the posts see only a steady thermal state.

In summary, since the refractory material used to form the riser has a relatively low tensile strength and is subjected to the aforementioned combination of stresses, the riser in the vicinity of the coupling assembly is typically one of the most frequent points of failure in transfer pumps.

SUMMARY OF THE INVENTION

Accordingly, it is a primary object of this invention to provide a new and improved molten metal transfer pump. It is an advantage of this invention to provide a new and improved riser assembly which is easy to install and maintain and provides a long service life. Additional objects and advantages of the invention will be set forth in part in the description which follows and in part will be obvious from the description or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the molten metal pump for transferring molten metal from a first vessel to a second vessel comprises a base member having a pumping chamber, a motor supported on a platform above the base member by at least one post, and a rotatable shaft secured at a first end to the motor and at a second end to an impeller which is disposed within the pumping chamber of the base. The pumping chamber includes an outlet to an elongated tube having a longitudinal axis which is substantially parallel to the axis of the shaft. The tube passes through an opening, which may include a notch in the platform and is fastened thereto by a unique fastening assembly. The fastening assembly is comprised of a member having a first portion secured to the platform and a second portion secured to a conduit leading to the second vessel. An additional area of the member is secured to a section of the tube. Accordingly, the fastening assembly secures the tube and the conduit to the platform and secures the conduit to the tube. Preferably, a gasket will be provided between the conduit and the tube.

Generally, the tube will be comprised of a graphite or ceramic material and include a metallic cladding over the portions in contact with the platform and the fastening assembly. Preferably, the conduit is comprised of a metallic material and includes a refractory lining. In a further preferred embodiment, the section of the conduit and section of the tube to which the stud is secured include cooperative mating flanges.

Preferably, the fastening assembly will include a metallic sheath secured to the tube and a semi-circular member attached to the platform which forms one side of an interface with the metallic sheath portion of the tube. A cooperative backing element will be secured to the tube opposite the semi-circular member by a U-bolt which allows for the releasable joining of the tube to the platform.

Alternatively, the point of attachment to the tube is a flange comprised of a split ring having a shallow V-shaped outer wall, and a pair of circular members on each element of the V-shaped wall. As a further alternative, the flange can be directly threaded to a metal cladding cemented to the outside of the tube.

In a further preferred embodiment of the invention, the tube includes a lower most end having a tapered outer wall which mates with a tapered recess of an adaptor which has an opposed end cemented into the base to provide fluid communication with the outlet.

BRIEF DESCRIPTION OF THE DRAWINGS

The invention consists in the novel parts, construction, arrangements, combinations and improvements shown and described. The accompanying drawings, which are incorporated in and constitute a part of this specification illustrate one embodiment of the invention and, together with a description, serve to explain the principles of the invention. Of the Drawings.

DETAILED DESCRIPTION OF THE INVENTION

Reference will now be made in detail to the present preferred embodiments of the invention, examples of which are illustrated in the accompanying drawings.

While the invention will be described in connection with a preferred embodiment, it will be understood that it is not intended to limit the invention to that embodiment. On the contrary, it is intended to cover all alternatives, modifications and equivalents that may be included within the spirit and scope of the invention defined by the appended claims.

The present invention is directed to a riser coupling which overcomes many of the problems associated with prior designs. One significant aspect of the inventive design is the use of a intermediate member which transfers force from the discharge piping assembly more directly to the motor mount, at least partially bypassing the riser, while also securing the riser to the motor mount and to the piping assembly.

Figure 1:
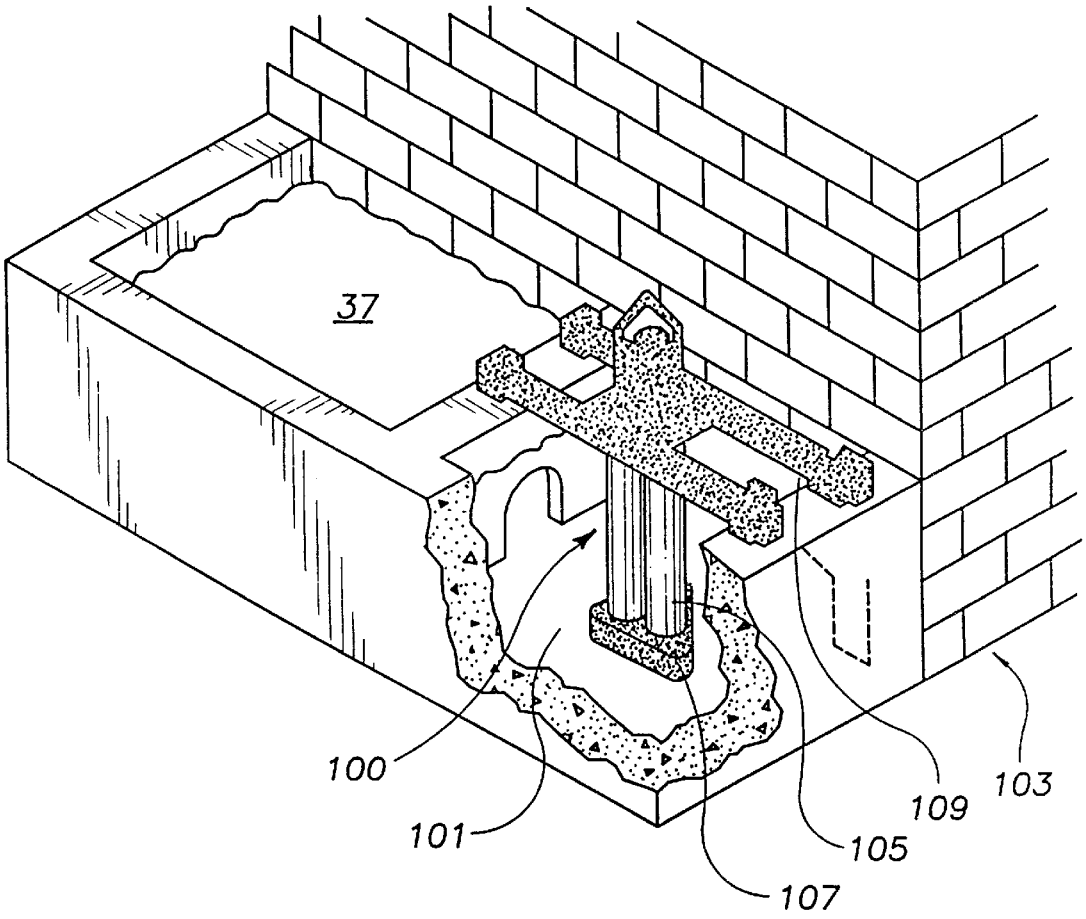
FIG. 1 is a perspective view of a molten metal transfer pump in a typical environment.

Referring now to FIG. 1, the typical environment of use and overall construction of a transfer pump are shown. Moreover, pump 100 is shown in a charge well 101 of a refractory furnace 103. As demonstrated, a riser tube 105 extends vertically from the pump base 107 and is mated to a transfer piping assembly 109 which will direct the molten metal away from the refractory furnace to any other desired location.

Figure 2:
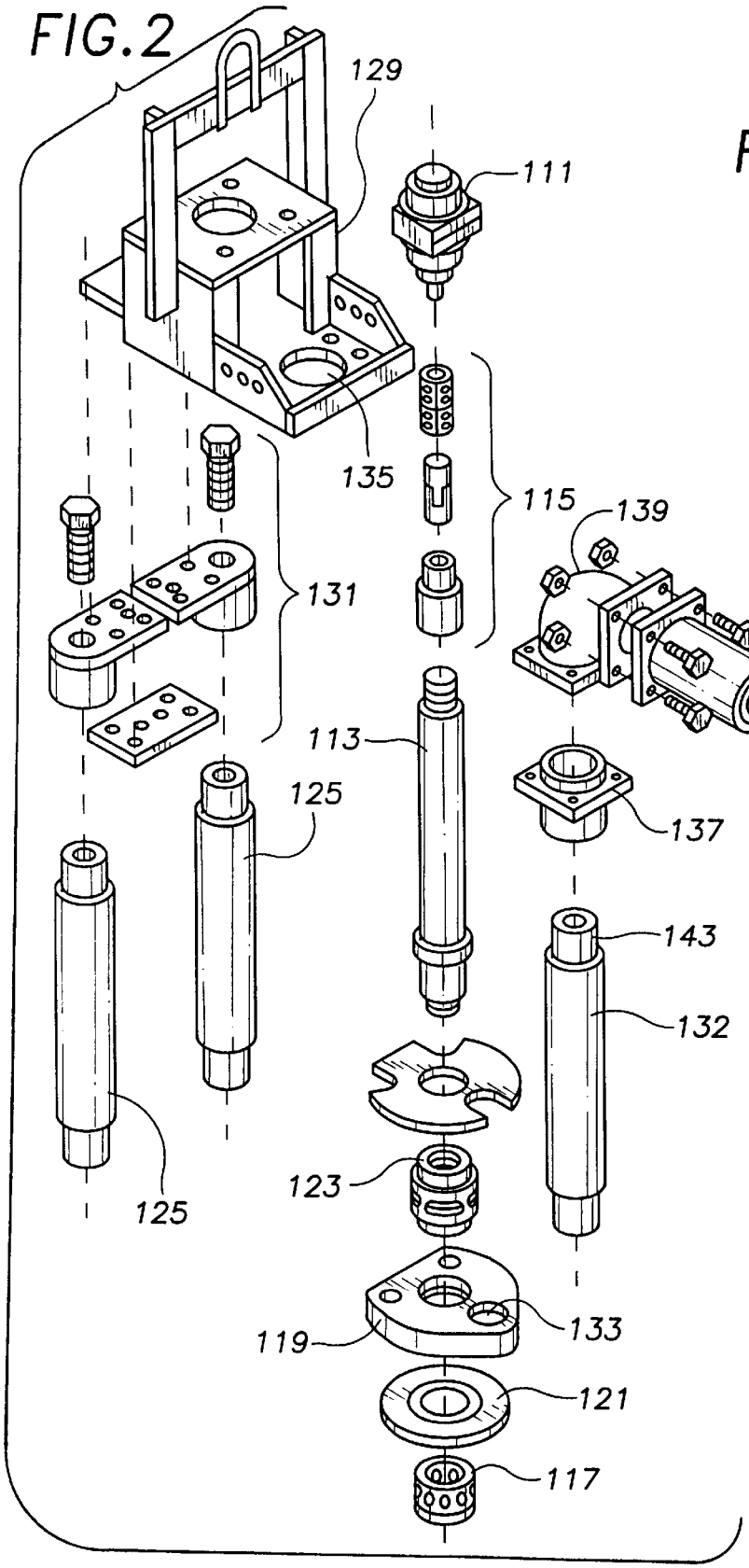
FIG. 2 is an exploded perspective view of a prior art molten metal transfer pump.

Turning specifically to the construction of a typical transfer pipe as shown in FIG. 2, the suitability of each of the components and overall design being appropriate for the present invention with the exception of the riser tube assembly, a motor 111 is attached to a rotatable shaft 113 by a coupling assembly 115. The shaft 113 is also attached at its lower end to a rotatable impeller 117 which rotates within the pumping chamber 118. A first bearing 121 is provided to allow proper rotation of the impeller and a second bearing 123 is provided to stabilize the rotation of the shaft 113. The motor 111 is supported and connected to the base assembly 119 by a pair of posts 125 which are attached to a motor mount platform 129 via bolt and socket assemblies 131.

A riser tube 132 has a first end disposed within an outlet 133 in the base 119 and is secured in a motor mount opening 135 via a coupling adaptor 137 to which elbow 139 is secured and provides a mating point for the transfer piping conduit 141. It is noted that an upper end 143 of the riser tube 132 typically extends beyond the coupling 137 to provide an interface with the elbow 139. It is again noted that the general assembly as depicted in FIG. 2 is representative of the construction of a transfer pump to which the present inventive riser assembly is suited. However, the present riser assembly is also recognized as suited to nearly any type of transfer pump in which a riser tube is employed.

Referring now to FIGS. 3–8 which show a first embodiment of the invention wherein the riser 1 passes through an opening 2 in the motor mount 3 and is secured thereto with a flange elements 5. The flange elements 5 surround a split ring 7 which encircles a sleeve 9 cemented to the riser. Motor mount 3 is comprised of a metal plate first layer 11 and layers of insulation 13 and molten metal resistant materials 15 as is typical in the art.

The riser 1 is secured via the split ring 7 and flange elements 5 to the motor mount by means of a stud 15 and a pair of nuts 17 and 18 which cooperatively compress flange elements 5 to provide a compression on the split ring 7 to clamp the riser 1. The discharge piping (not shown) is secured to the riser 1 via a connecting member 19 having a metallic outer portion 21 and a refractory lined inner core 23. Connecting member 19 includes a flanged face 25 including a bore 27 which accommodates the stud 15. A cooperative nut 29 and clamp collar 31 function to accurately lock element 19 in its desired position relative to the riser 1. Preferably, a gasket (not shown) will be placed intermediate the riser 1 and the connecting member 19.

In this manner, molten metal pumped through the outlet 33 in the base member 35 is transferred to a second vessel. More particularly, molten metal within a bath (see 37 of FIG. 1) is passed through the pumping chamber (not shown in this view) through outlet 33, through an adaptor member 39, and into riser 1.

Figure 4:
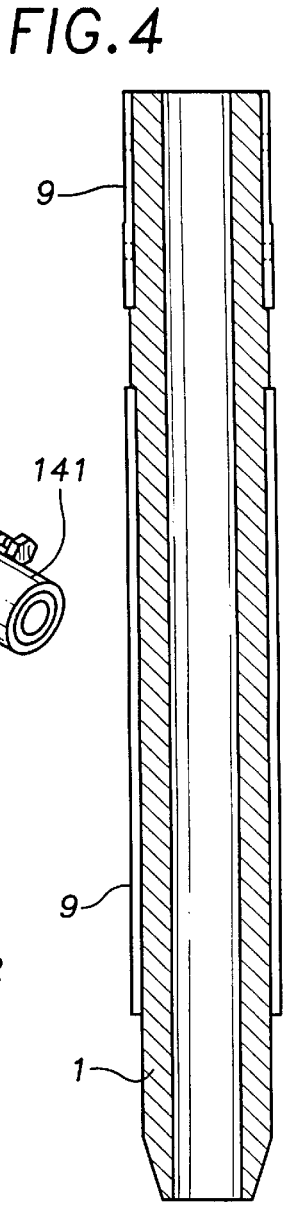
FIG. 4 is a cross-sectional view of a riser tube including a protective metallic cladding.
Figure 3:
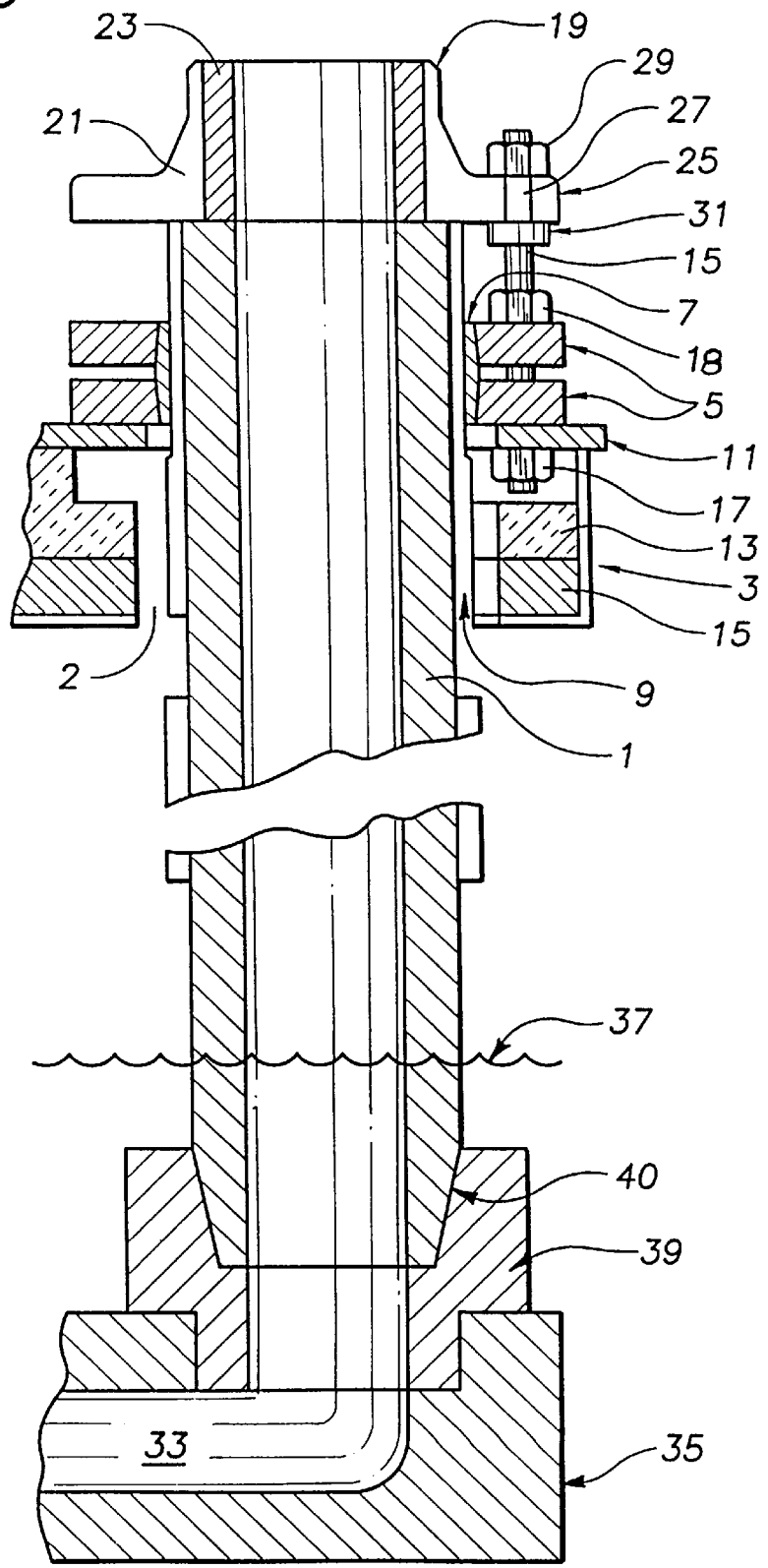
FIG. 3 is a cross-sectional exploded view of one embodiment of the mating assembly between the pump platform and the riser tube.
Figure 8:
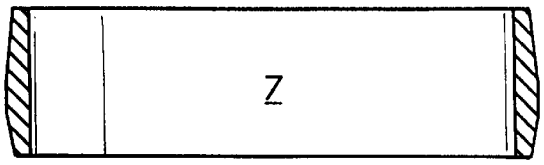
FIGS. 7 and 8 are top plan views and cross-sectional views respectively of the split ring.
Figure 5:
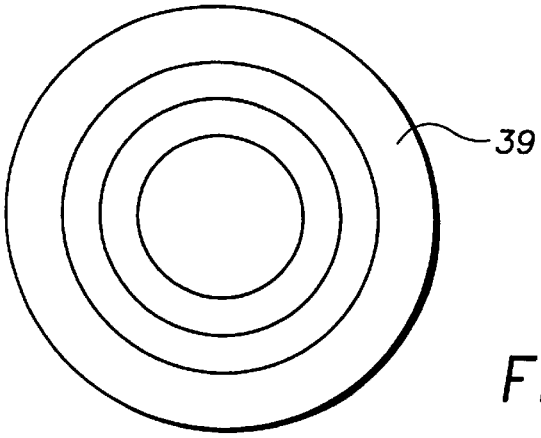
FIGS. 5 and 6 are a top plan view and a cross-sectional view, respectively of the base adaptor mating unit.
Figure 7:
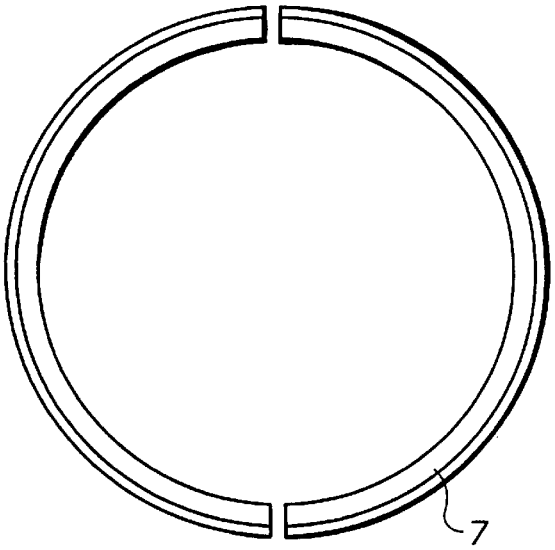
Figure 6:
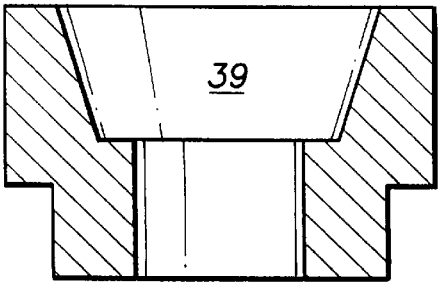

An additional design advantage of the present invention is the inclusion of adaptor 39 between the riser 1 and base 35. Particularly, the adaptor 39 is cemented into the base 35 and riser 1 remains fitted into the tapered recess 40 as a result of compression from the weight of the motor mount, etc. It is noted that this provides for a readily changeable tube as necessary while it maintains excellent seating ability given the adjustability provided by the inventive coupling assembly. FIG. 4 is a cross-sectional view of the riser, showing the locations in which protective metallic cladding is cemented.

Figure 9:
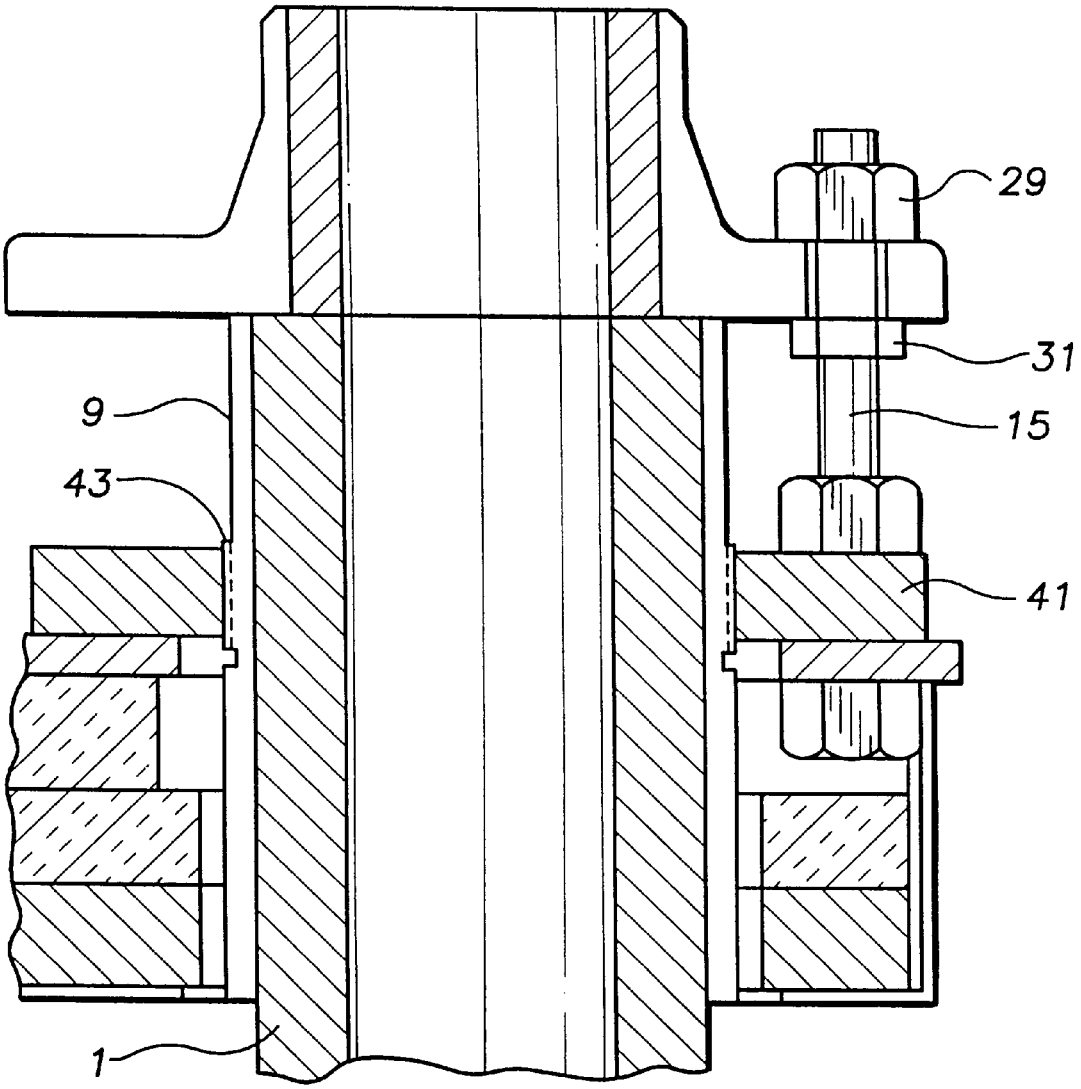
FIG. 9 is a cross-sectional view of an alternative mating assembly between the platform and the riser tube.

Referring now to FIG. 9, an alternative embodiment is shown. Of particular interest in this view is the use of a threaded flange 41 which includes an internal thread which mates with a threaded outer wall 43 machined into the metallic cladding 9 on the outer wall of the riser tube of riser 1. In this instance, a connecting member 19 to the discharge piping is again secured to the end of the riser 1 by connecting it to the stud 15 with a cooperative nut and collar 29 and 31, respectively. The gasket (not shown) which is secured between these two elements can be precisely compressed and adjustment is easy to achieve by adjusting the threaded clamp collar which in turn limits the travel of the discharge piping. Accordingly, stresses on the riser resulting from over or uneven torquing encountered in prior designs are avoided.

Figure 10:
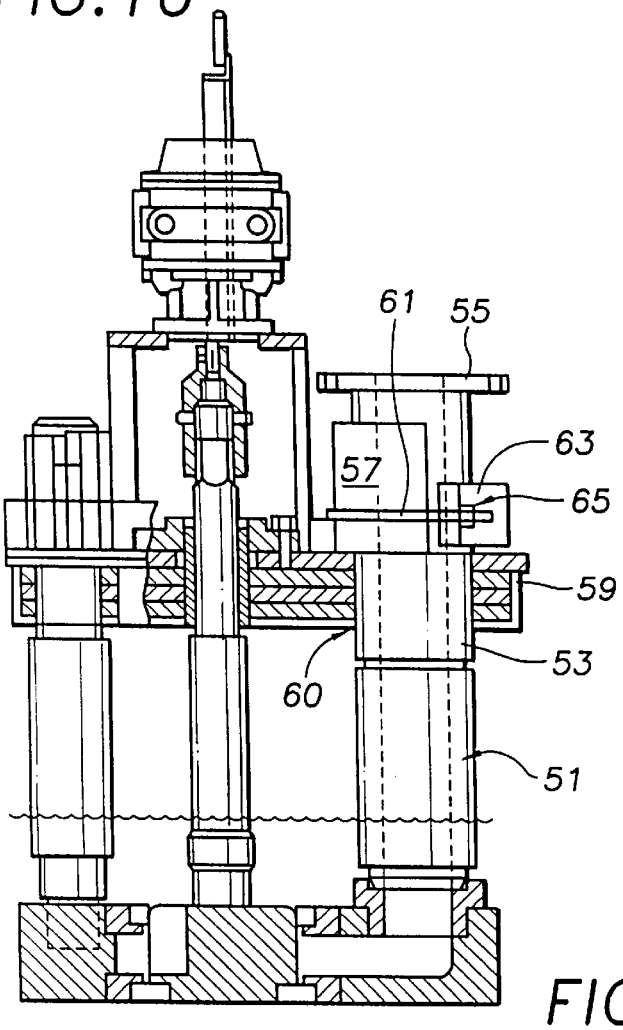
FIG. 10 is a side elevation view, partially in cross-section, of a transfer pump equipped with an alternative embodiment of the inventive riser tube assembly.
Figure 12:
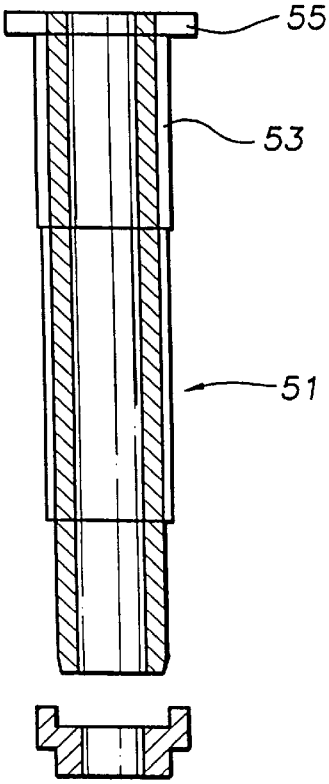
FIG. 12 is a top plan view, partially in cross-section of the riser tube of FIG. 10
Figure 11:
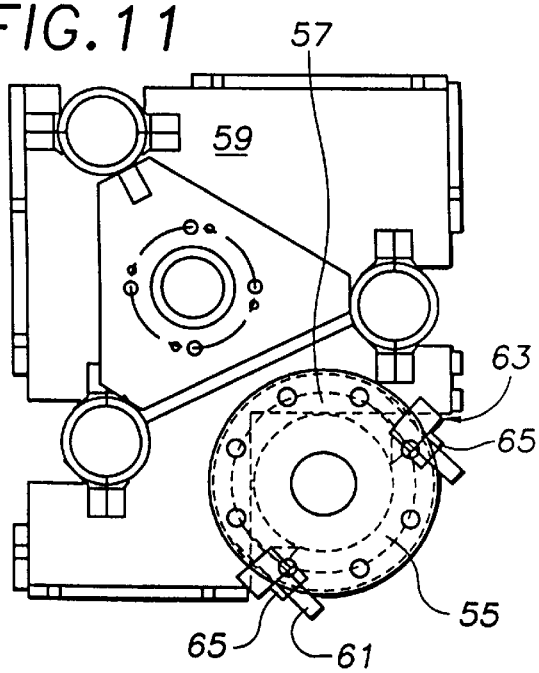
FIG. 11 is a top plan view of the pump of FIG. 10.

Referring now to FIGS. 10–12, a third alternative embodiment of the invention is depicted. In this embodiment a riser tube 51 includes a metallic cladding 53 (preferably cemented in place) equipped with a flange member 55 at its upper most end. This flange member is provided to form an interface with the piping assembly (not shown). Primary mating tab 57 is welded to the upper surface of platform 59 adjacent an opening 60 in the platform 59 through which the riser 51 passes. A U-bolt 61 passes around the tab 57 and is mated to a backing member 63 by a pair of nuts 65 to secure the riser tube 51 in position. A particular advantage of this design is the ease of vertical adjustment of the riser to obtain appropriate mating with the piping assembly. This adjustability of the riser in combination with the use of the adaptor element as described previously, allows ease of installation into any facility, and a readily changeable riser tube. Since a plurality of sized adaptor elements can be provided or a machining of the adaptor tube can be easily performed, an additional means of adjustment is available to the pump installer.

As those skilled in the art will recognize, many advantages are provided by the inventive design. For example, the present invention does not rigidly attach the riser to the base, using mating tapers instead. This allows for less stressful movement from thermal expansion differences. The inventive design also functionally separates the fasteners used to hold the riser socket to the motor mount from those used to compress the gasket. Accordingly, specific stress to secure the riser to the motor mount can be lessened. The compression on the gasket, which in the prior art design was often extremely severe as a result of primary supportive load being applied at that point, is reduced in the present design where the primary supportive load for the discharge piping is placed on the stud and motor mount. Similarly, any force applied to the riser from the discharge piping is compressive rather tensile. Since refractory materials are typically much stronger in compression, an additional advantage is provided. Finally, it is also noted that the present riser assembly is easily replaced should damage occur. In contrast, prior assemblies required chiseling to remove the cemented parts.

Most importantly, the print designs allow for vertical adjustment of the riser to accommodate thermal expansion and obtain precise mating with piping assembling in any installation.

Thus it is apparent that there has been provided, in accordance with the invention a molten metal transfer pump that fully satisfies the objects, aims and advantages set forth above. While the invention has been described in conjunction with specific embodiments thereof, it is evident that many alternatives, modifications, and variations will be apparent in those skilled in the art in light of the foregoing description. Accordingly, it is intended to embrace all such alternatives, modifications and variations that fall within the spirit and broad scope of the appended claims.

We claim:

1. A molten metal pump for transferring molten metal from a first vessel to a second vessel, the pump comprising a base member including a pumping chamber, a motor supported on a platform by at least one post, a rotatable shaft secured at a first end to said motor and at a second end to an impeller disposed within said pumping chamber, the pumping chamber including an outlet to a first end of an elongated refractory tube having a longitudinal axis substantially parallel to said shaft, said tube having a second end passing through an opening in said platform, said tube including a metallic cladding attached to an outer wall adjacent said second end, a releasable fastening member engaging said metallic cladding and securing said tube to said platform, said metallic cladding forming a portion of a connection to a piping assembly, and said tube being selectively vertically adjustable within said fastening member.

2. The pump of claim 1 wherein said tube is comprised of graphite.

3. The pump of claim 1 wherein said metallic cladding includes a flange mating with said piping assembly.

4. The pump of claim 1 wherein said fastening assembly comprises a primary member welded to said platform, a backing element and a U-bolt passing around said member and tube and securing said backing element, said primary member, U-bolt and backing element acting in concert to secure said tube to said platform.

5. The pump of claim 1 wherein said cladding is cemented to said tube.

6. The pump of claim 1 wherein said first end of said tube is attached to said pumping chamber outlet with an adaptor element.

7. The pump of claim 4 wherein said member is generally shaped to provide a cooperative mating surface with said tube.

8. The pump of claim 7 wherein said backing element includes an arcuate mating face with said tube.

9. The pump of claim 1 including a gasket between said tube and said piping assembly.

10. A molten metal pump for transferring molten metal from a first vessel to a second vessel, the pump comprising a base member including a pumping chamber, a motor supported on a platform above said base member by at least one post, a rotatable shaft secured at a first end to said motor and at a second end to an impeller disposed within said pumping chamber, the pumping chamber including an outlet to an elongated tube having a longitudinal axis generally parallel to said shaft, said tube passing through an opening in said platform, a fastening assembly comprised of a stud having a first end secured to said platform, a second end secured to a section of a conduit in fluid communication with said second vessel, and an intermediate segment secured to a section of said tube, said fastening assembly securing a mating surface between said tube and said to conduit.

11. The pump of claim 10 wherein said tube is comprised of graphite or ceramic.

12. The pump of claim 10 wherein said conduit is comprised of a metallic material having a refractory lining.

13. The pump of claim 10 wherein a gasket is positioned at said mating surface between said conduit and said tube.

14. The pump of claim 10 wherein a flange is positioned around said tube, said flange including a hole which accommodates said stud and permits said stud to be secured to said tube.

15. The pump of claim 14 wherein said flange is comprised of a pair of circular elements positioned on the opposed V-shaped outer walls of a split ring.

16. The pump of claim 10 wherein said tube includes at least partial cladding of metallic material.

17. The pump of claim 14 wherein said flange is threaded to an outer wall of said tube.

18. The pump of claim 10 wherein said conduit includes a flange adjacent the mating surface, said flange including a hole sized to accommodate said stud.

19. The pump of claim 18 wherein said stud is threaded and a plurality of nuts secure said flanges to said stud.

20. The pump of claim 10 wherein said tube includes an end connected to said outlet, said connection being formed via an adaptor, said adaptor including a recess which is tapered to mate with a beveled end of said tube, an opposed end of said adaptor being cemented into said base.

* * * * *

UNITED STATES PATENT AND TRADEMARK OFFICE

CERTIFICATE OF CORRECTION

PATENT NO : 5,947,705

DATED : September 7, 1999

INVENTOR(S) : George S. Mordue, Chris T. Vild, Herbert L. Ritchie

It is certified that error appears in the above-identified patent and that said Letters Patent are hereby corrected as shown below:

Column 6, line 32, delete "to".

Signed and Sealed this

Eighth Day of February, 2000

*Attest:*

Q. TODD DICKINSON

*Attesting Officer*

*Commissioner of Patents and Trademarks*